US007434493B2

(12) United States Patent
Huang

(10) Patent No.: US 7,434,493 B2
(45) Date of Patent: Oct. 14, 2008

(54) RATCHET DRIVING MECHANISM WITH TWO SETS OF PAWLS

(76) Inventor: Chin-Tan Huang, No. 39, Lane 240, Li-Jen Rd., Ta-Li City, Taichung Hsien (TW)

( * ) Notice: Subject to any disclaimer, the term of this patent is extended or adjusted under 35 U.S.C. 154(b) by 148 days.

(21) Appl. No.: 11/619,662

(22) Filed: Jan. 4, 2007

(65) Prior Publication Data

US 2008/0163724 A1 Jul. 10, 2008

(51) Int. Cl.
*B25B 13/46* (2006.01)

(52) U.S. Cl. ..... 81/63.1; 192/43.2

(58) Field of Classification Search ..... 81/62, 81/63.1, 63.2; 192/43.2
See application file for complete search history.

(56) References Cited

U.S. PATENT DOCUMENTS 3,222,943 A * 12/1965 McDonald ..... 74/157
6,227,077 B1 * 5/2001 Chiang ..... 81/63.1
6,854,363 B2 * 2/2005 Ping ..... 81/63.1
7,237,459 B1 * 7/2007 Shiao ..... 81/62
2007/0240544 A1 * 10/2007 Hu ..... 81/63.1

* cited by examiner

*Primary Examiner*—D. S Meislin
(74) *Attorney, Agent, or Firm*—Ladas & Parry LLP

(57) ABSTRACT

A ratchet driving mechanism includes a main body, an adjusting ring, and a ratchet wheel. The main body includes a grip-connecting member and a rotary seat connected fixedly to the grip-connecting member. The rotary seat is formed with two parallel insertion slots, in each of which two pawls are biased by a spring to move away from each other. The adjusting ring and the ratchet wheel are sleeved rotatably on the rotary seat. When the adjusting ring is disposed in an anchoring position, the pawls engage the ratchet wheel so as to prevent rotation of the ratchet wheel on the rotary seat. When the adjusting ring is disposed in a first-direction position or a second-direction position, two of the pawls engage the ratchet wheel so as to allow for rotation of the ratchet wheel on the rotary seat in only a corresponding direction.

4 Claims, 8 Drawing Sheets

RATCHET DRIVING MECHANISM WITH TWO SETS OF PAWLS

BACKGROUND OF THE INVENTION

1. Field of the Invention

This invention relates to a ratchet driving mechanism, and more particularly to a ratchet driving mechanism that includes two sets of pawls.

2. Description of the Related Art

Referring to FIGS. 1 and 2, a ratchet driving mechanism 1 disclosed in U.S. Pat. No. 6,047,802 by the applicant is used to interconnect a screwdriver 20 and a grip 30, and includes an anchoring unit 11, a switching unit 12, and a ratchet unit 13.

The anchoring unit 11 is connected to the grip 30, and includes a main body 111, which has opposite first and second end surfaces 112, 113, and an annular outer surface 114 interconnecting the first and second end surfaces 112, 113. The first end surface 112 is formed with two open-ended slots 115 parallel to each other.

The switching unit 12 includes an adjusting ring 121 sleeved rotatably on the main body 111 and having an inner surface formed with two retaining grooves 122.

The ratchet unit 13 includes a ratchet wheel 131 connected to the screwdriver bit 20 and sleeved rotatably on the main body 111, two resilient members 132 disposed respectively within the slots 115, and first and second pawls 133, 134 disposed respectively within the slots 115 and biased respectively by the resilient members 132 to project respectively from the slots 115. The ratchet wheel 131 has a ratchet-toothed annular inner surface 135.

The adjusting ring 121 is operable to rotate among an anchoring position shown in FIG. 2, a first-direction position shown in FIG. 3, and a second-direction position shown in FIG. 4.

When the adjusting ring 121 is disposed in the anchoring position, each of the first and second pawls 133, 134 engages a respective one of the retaining grooves 122 and the ratchet-toothed annular inner surface 135. As such, rotation of the ratchet wheel 131 on the main body 111 is prevented.

When the adjusting ring 121 is disposed in the first-direction position, only the second pawl 134 engages the corresponding retaining groove 122 and the ratchet-toothed annular inner surface 135 so as to allow for rotation of the ratchet wheel 131 on the main body 111 in only a first rotational direction (A).

When the adjusting ring 121 is disposed in the second-direction position, only the first pawl 133 engages the corresponding retaining groove 122 and the ratchet-toothed annular inner surface 135 so as to allow for rotation of the ratchet wheel 131 on the main body 111 in only a second rotational direction (B) that is opposite to the first rotational direction (A).

When the adjusting ring 121 is disposed in the first-direction or second-direction position, due to engagement between the ratchet-toothed annular inner surface 135 and only a single pawl 133, 134, an insufficient driving surface is obtained such that only a minimal torque may be accommodated. As a result, the ratchet-toothed annular inner surface 135 as well as the first and second pawls 133, 134 easily experience wearing during operation, thereby reducing the service life of the ratchet driving mechanism.

SUMMARY OF THE INVENTION

The object of this invention is to provide a ratchet driving mechanism that accommodates a large torque and has a long service life.

According to this invention, a ratchet driving mechanism includes a main body, an adjusting ring, and a ratchet wheel. The main body includes a grip-connecting member and a rotary seat connected fixedly to the grip-connecting member. The rotary seat is formed with two parallel insertion slots, in each of which two pawls are biased by a spring to move away from each other. The adjusting ring and the ratchet wheel are sleeved rotatably on the rotary seat. When the adjusting ring is disposed in an anchoring position, the pawls engage the ratchet wheel so as to prevent rotation of the ratchet wheel on the rotary seat. When the adjusting ring is disposed in a first-direction position or a second-direction position, two of the pawls engage the ratchet wheel so as to allow for rotation of the ratchet wheel on the rotary seat in only a corresponding direction.

Due to the presence of two sets of pawls, a sufficient driving surface is provided, ultimately increasing the service life of the ratchet driving mechanism.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
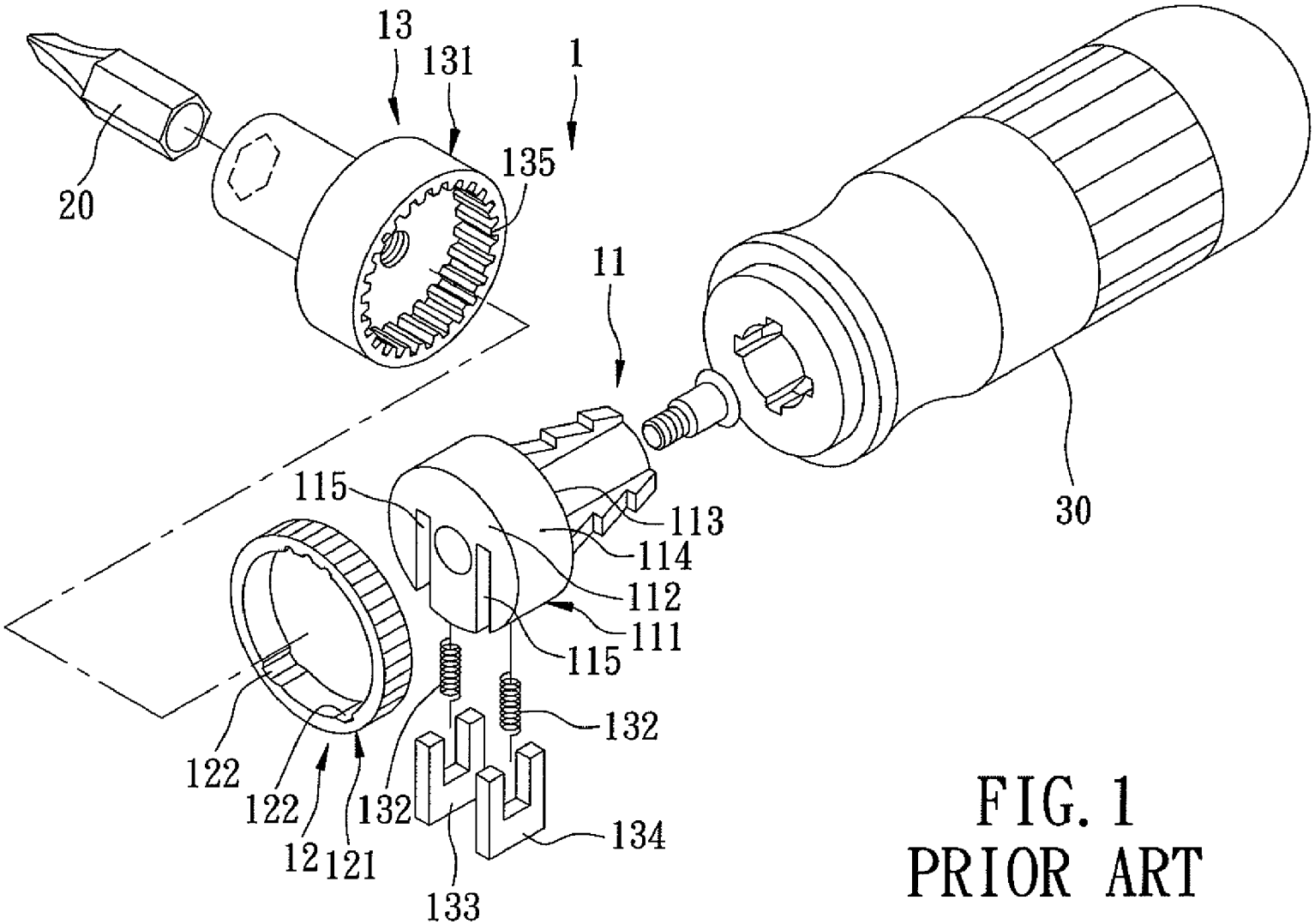
FIG. 1 PRIOR ART
FIG. 1 is an exploded perspective view of a conventional ratchet driving mechanism disclosed in U.S. Pat. No. 6,047,802.
Figure 2:
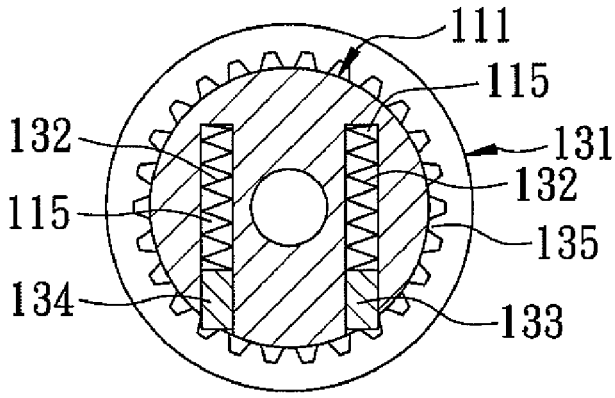
FIG. 2 PRIOR ART
FIG. 2 is a sectional view of the conventional ratchet driving mechanism, illustrating an anchoring position of an adjusting ring.
Figure 3:
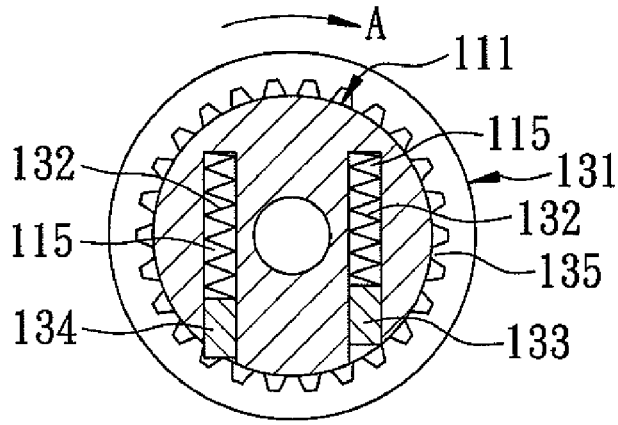
FIG. 3 PRIOR ART
FIG. 3 is a sectional view of the conventional ratchet driving mechanism, illustrating a first-direction position of the adjusting ring.
Figure 4:
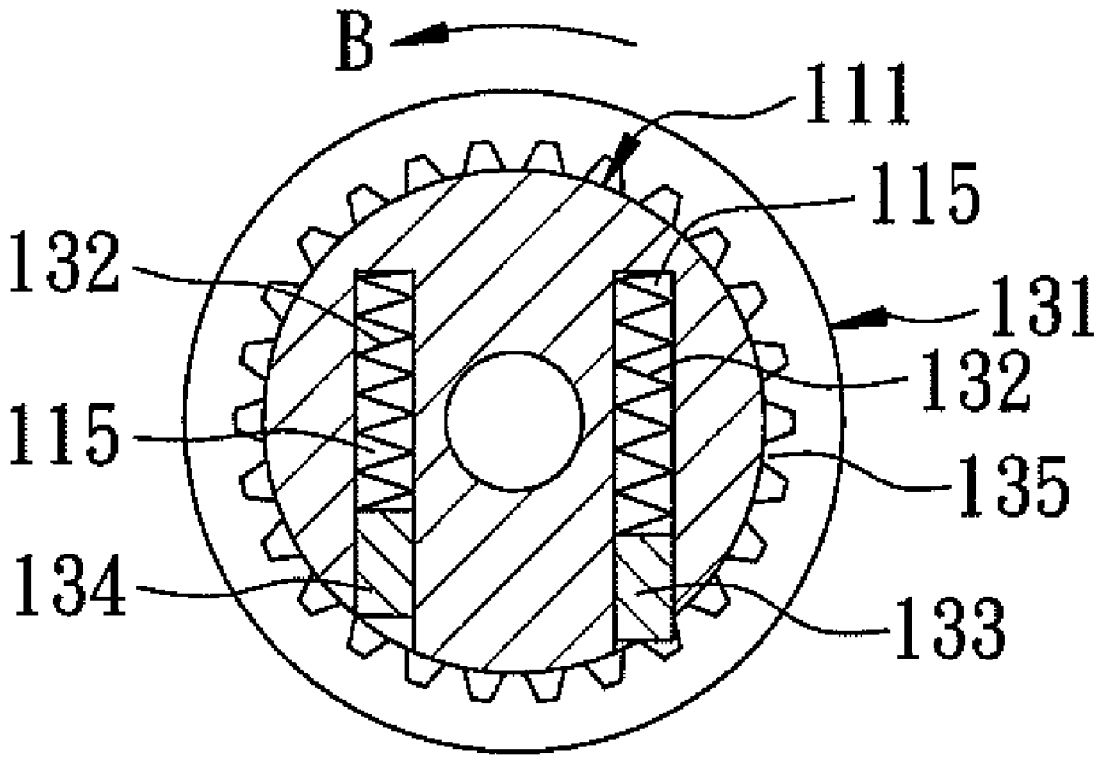
FIG. 4 PRIOR ART
FIG. 4 is a sectional view of the conventional ratchet driving mechanism, illustrating a second-direction position of the adjusting ring.
Figure 5:
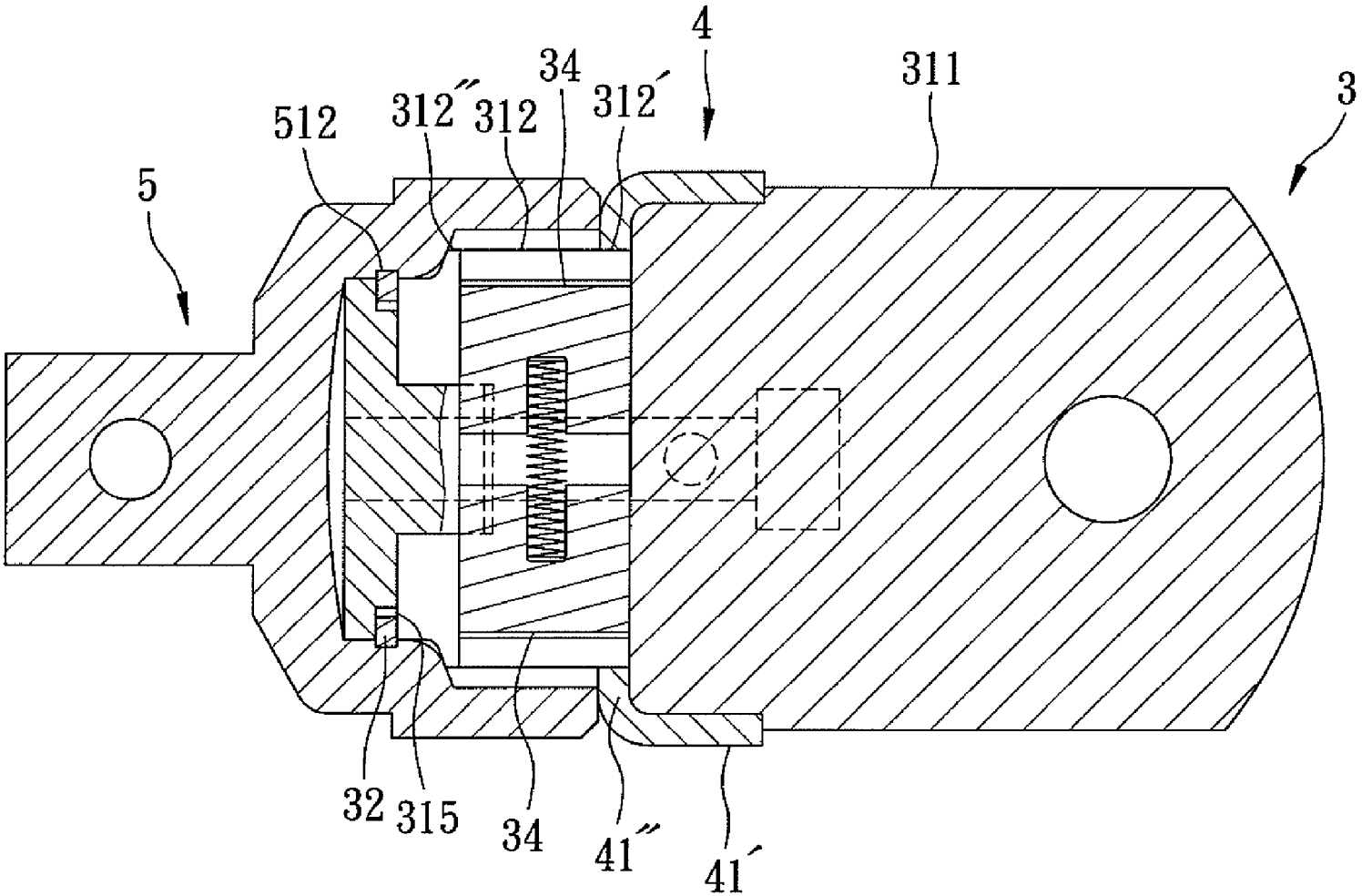
FIG. 5 is a sectional view of the preferred embodiment of a ratchet driving mechanism according to this invention.
Figure 5A:
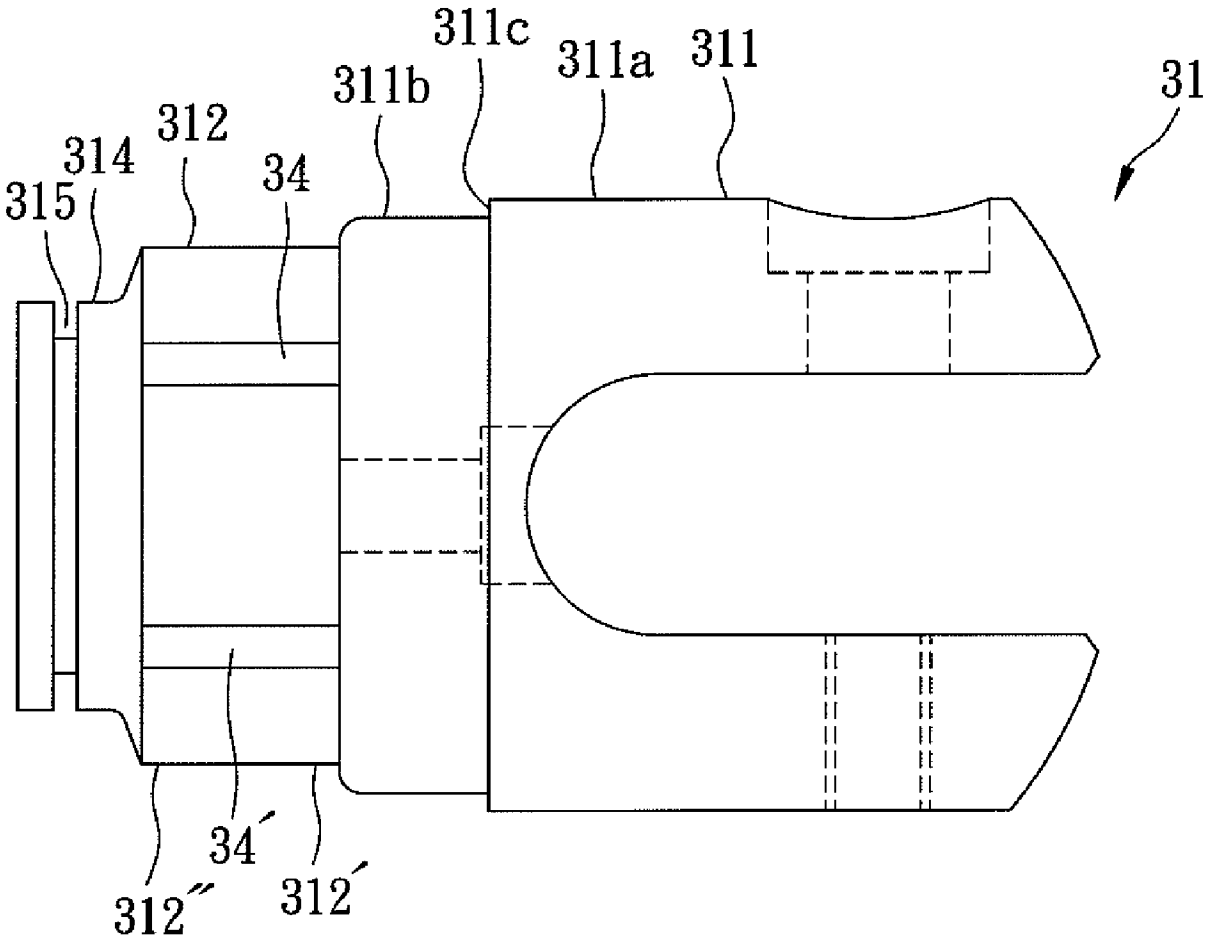
FIG. 5A is a side view of a main body of the preferred embodiment.
Figure 7:
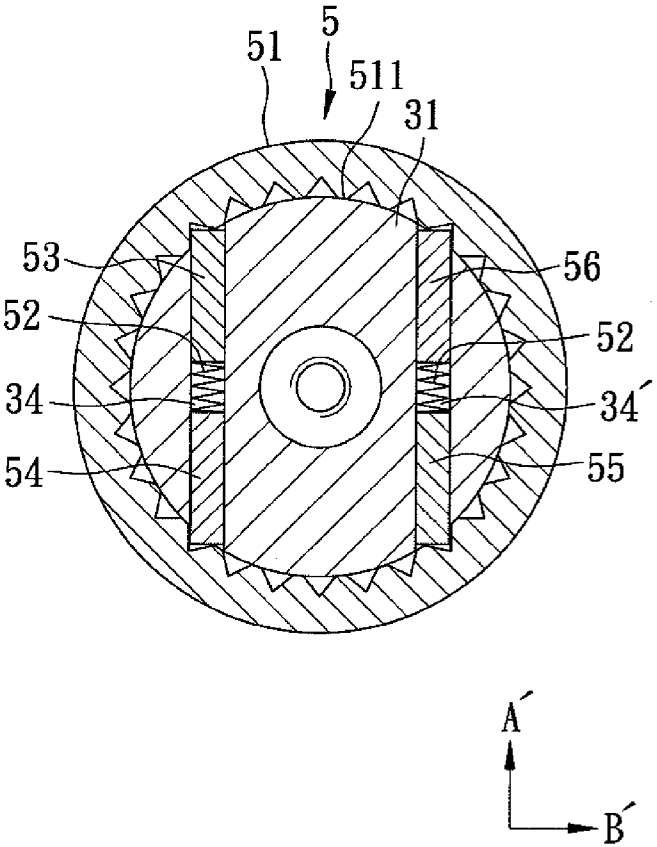
FIG. 7 is a sectional view of the preferred embodiment, illustrating how rotation of a ratchet wheel on a rotary seat is prevented when the adjusting ring is disposed in the anchoring position.
Figure 6:
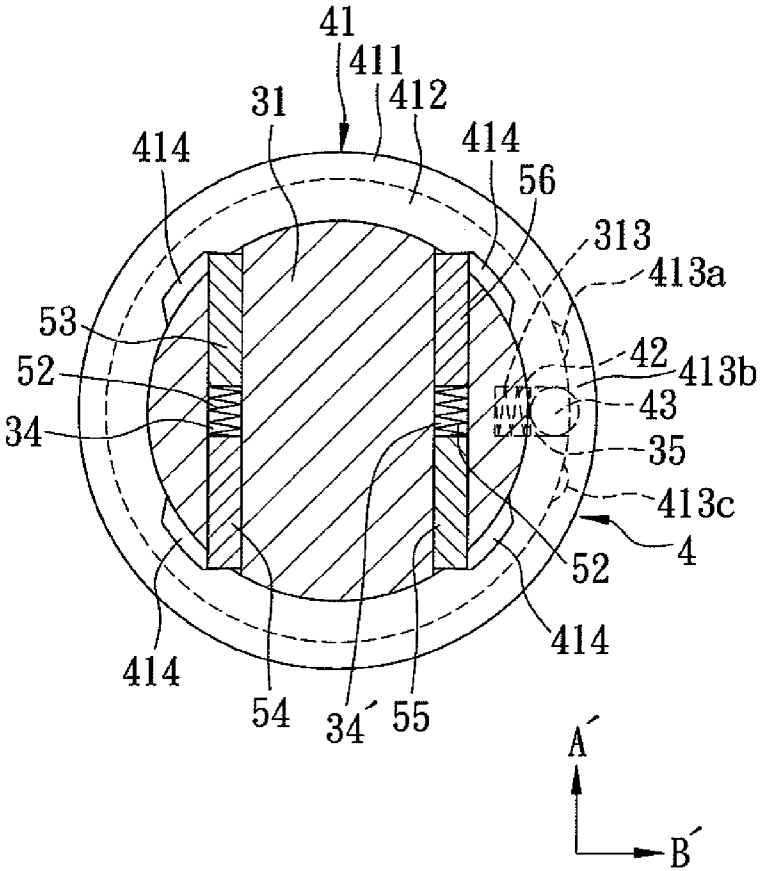
FIG. 6 is a sectional view of the preferred embodiment when an adjusting ring is disposed in an anchoring position.

Referring to FIGS. 5, 5A, 6, and 7, the preferred embodiment of a ratchet driving mechanism according to this invention is adapted to interconnect a grip (not shown) and a screwdriver bit (not shown), and includes an anchoring unit 3, a switching unit 4, and a ratchet unit 5.

The anchoring unit 3 includes a main body 31 and a C-shaped retaining ring 32. The main body 31 includes a grip-connecting member 311 and a cylindrical rotary seat 312 that is connected fixedly to the grip-connecting member 311 and that has a first end 312' proximate to the grip-connecting member 311, a second end 312" opposite to the first end 312' and distal from the grip-connecting member 311, and a pair of first and second insertion slots 34, 34' formed through the rotary seat 312 and parallel to each other. Each of the first and second insertion slots 34, 34' extends along a first transverse direction (A'), and has two opposite ends formed in an annular outer surf ace of the rotary seat 312.

The switching unit 4 includes an adjusting ring 41, a coiled compression spring 42, and a ball 43. The adjusting ring 41 is sleeved rotatably on the first end 312' of the rotary seat 312, and has an annular inner surface formed with four retaining grooves 414. The adjusting ring 41 is rotatable relative to the rotary seat 312 among an anchoring position shown in FIGS. 6 and 7, a first-direction position shown in FIGS. 8 and 9, and a second-direction position shown in FIGS. 10 and 11.

The grip-connecting member 311 has a large-diameter portion 311*a*, a small-diameter portion 311*b* connected integrally to the large-diameter portion 311*a* and having an outer diameter smaller than that of the large-diameter portion 311*a*, and a shoulder 311*c* defined between the large-diameter and small-diameter portions 311*a*, 311*b*. The rotary seat 312 is connected fixedly to an end surface of the small-diameter portion 311*b* distal from the large-diameter portion 311*a*, and has an outer diameter smaller than that of the small-diameter portion 311*b*.

The adjusting ring 41 has a cylindrical portion 41' sleeved on the small-diameter portion 311*b* of the grip-connecting member 311 in a close-fitting manner, and has an end abutting against the shoulder 311*c*, and an inward flange 41" extending radially and inwardly from the other end of the cylindrical portion 41' and formed with the retaining grooves 414. The inward flange 41" has an inner periphery abutting against the rotary seat 312. That is, the inward flange 41" is sleeved on the rotary seat 312.

The cylindrical portion 41' has an annular inner surface formed with first, second, and third positioning grooves 413*a*, 413*b*, 413*c* arranged in a circumferential direction thereof. The small-diameter portion 311*b* of the grip-connecting member 311 has an annular outer surface formed with a blind hole 313 (see FIG. 6), within which the spring 42 and the ball 43 are disposed. The ball 43 is biased by the spring 42 to project from the blind hole 313. The adjusting ring 41 is operable to rotate on the rotary seat 312 so as to engage the ball 43 with a selected one of the first, second, and third positioning grooves 413*a*, 413*b*, 413*c* in the adjusting ring 41, thereby maintaining the adjusting ring 41 at a corresponding one of the anchoring position, the first-direction position, and the second-direction position.

The ratchet unit 5 includes a ratchet wheel 51 sleeved rotatably on the second end 312" of the rotary seat 312, two coiled compression springs 52, and first, second, third and fourth pawls 53, 54, 55, 56. The ratchet wheel 51 has a ratchet-toothed annular inner surface 511. The first and second pawls 53, 54 are disposed within the first insertion slot 34 in the rotary seat 312. The third and fourth pawls 55, 56 are disposed within the second insertion slot 34' in the rotary seat 312. One of the compression springs 52 is disposed within the first insertion slot 34 between the first and second pawls 53, 54 so as to bias the first and second pawls 53, 54 away from each other to thereby project respectively from the ends of the first insertion slot 34. The other of the compression springs 52 is disposed within the second insertion slot 34' between the third and fourth pawls 55, 56 so as to bias the third and fourth pawls 55, 56 away from each other to thereby project respectively from the ends of the second insertion slot 34'. The first and fourth pawls 53, 56 are aligned with each other in a second transverse direction (B') perpendicular to the first transverse direction (A'). The second and third pawls 54, 55 are aligned with each other in the second transverse direction (B').

The main body 311 further includes a retaining member 314 disposed within the ratchet wheel 51 and connected fixedly to and extending axially from the rotary seat 312. The retaining member 314 has an annular surface formed with an annular groove 315. The ratchet wheel 51 has an annular inner surface formed with an annular groove 512. The C-shaped retaining 32 engages the annular grooves 315, 512 in the retaining member 314 and the ratchet wheel 51 so as to prevent removal of the main body 311 from the ratchet wheel 51.

When the adjusting ring 41 is disposed in the anchoring position, each of the first, second, third, and fourth pawls 53, 54, 55, 56 engages a respective one of the retaining grooves 414 in the adjusting ring 41 and the ratchet-toothed annular inner surface 511 of the ratchet wheel 51 so as to prevent rotation of the ratchet wheel 51 on the rotary seat 312.

Figure 9:
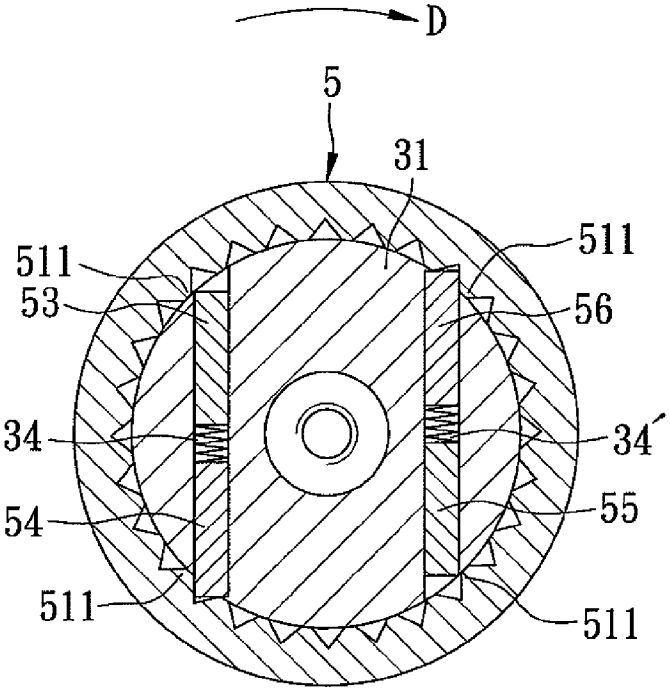
FIG. 9 is a sectional view of the preferred embodiment, illustrating how the ratchet wheel is limited to rotate on the rotary seat in only a first rotational direction.
Figure 8:
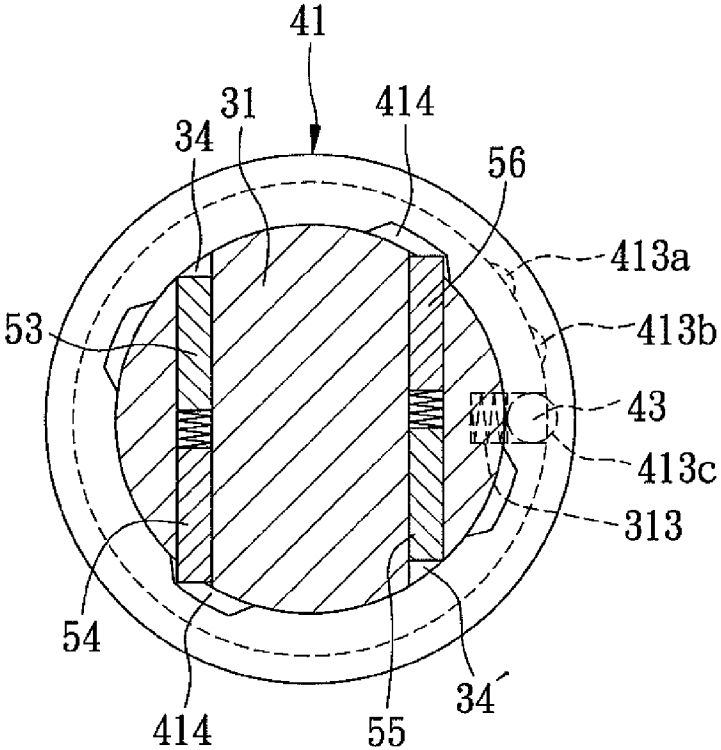
FIG. 8 is a sectional view of the preferred embodiment when the adjusting ring is disposed in a first-direction position.

With further reference to FIGS. 8 and 9, when the adjusting ring 41 is disposed in the first-direction position, only the second and fourth pawls 54, 56 engage two corresponding ones of the retaining grooves 414, respectively, and the ratchet-toothed annular inner surface 511 so as to allow for rotation of the ratchet wheel 51 on the rotary seat 312 in only a first rotational direction (D).

Figure 11:
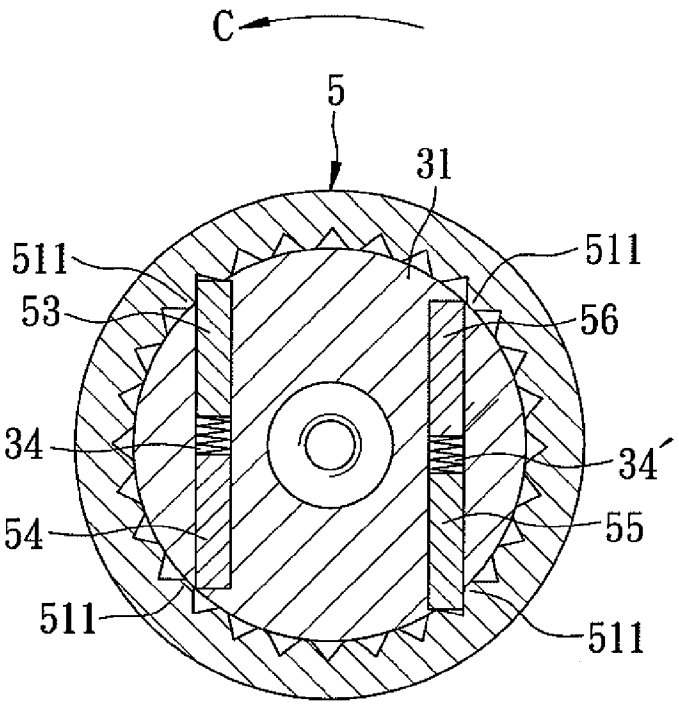
FIG. 11 is a sectional view of the preferred embodiment, illustrating how the ratchet wheel is limited to rotate on the rotary seat in only a second rotational direction.
Figure 10:
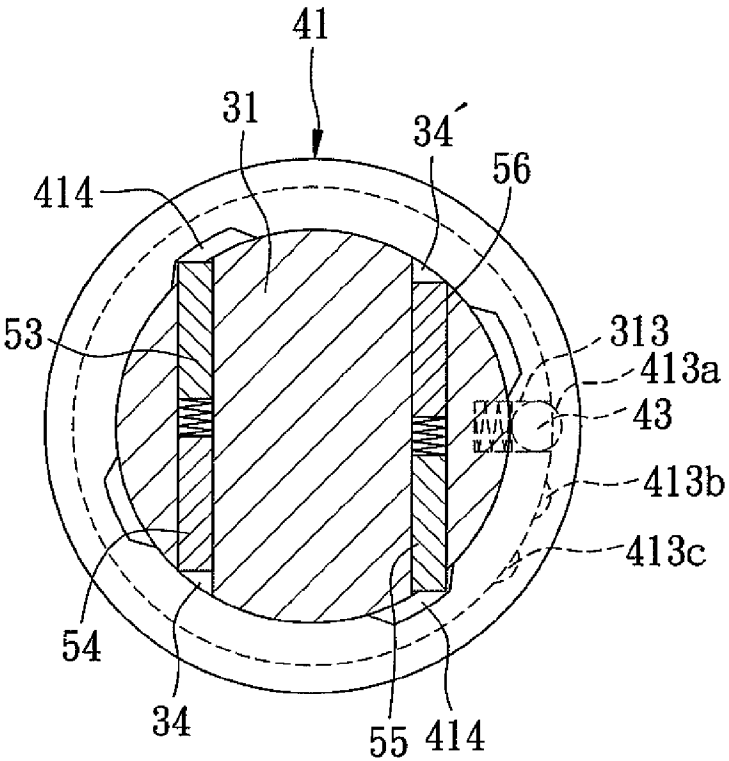
FIG. 10 is a sectional view of the preferred embodiment when the adjusting ring is disposed in a second-direction position.

With additional reference to FIGS. 10 and 11, when the adjusting ring 41 is disposed in the second-direction position, only the first and third pawls 53,55 engage two corresponding ones of the retaining grooves 414, respectively, and the ratchet-toothed annular inner surface 511 so as to allow for rotation of the ratchet wheel 51 on the rotary seat 312 in only a second rotational direction (C) that is opposite to the first rotational direction (D).

Due to the presence of two sets of pawls 53, 54, 55, 56, a large driving surface is provided so that a significant torque may be accommodated, ultimately, the service life of the ratchet driving mechanism are increased significantly.

With this invention thus explained, it is apparent that numerous modifications and variations can be made without departing from the scope and spirit of this invention. It is therefore intended that this invention be limited only as indicated by the appended claims.

I claim:

1. A ratchet driving mechanism comprising:

a main body including a grip-connecting member and a cylindrical rotary seat that is connected fixedly to said grip-connecting member and that has a first end proximate to said grip-connecting member, a second end opposite to said first end and distal from said grip-connecting member, and a pair of first and second insertion slots formed through said rotary seat, each of said first and second insertion slots extending along a first transverse direction and having two opposite ends formed in an annular outer surface of said rotary seat;

an adjusting ring sleeved rotatably on said first end of said rotary seat and having an annular inner surface formed with four retaining grooves, said adjusting ring being rotatable relative to said rotary seat among an anchoring position, a first-direction position, and a second-direction position;

a ratchet unit including a ratchet wheel sleeved rotatably on said second end of said rotary seat, a first pawl, a second pawl, a third pawl, a fourth pawl, and two compression springs, said ratchet wheel having a ratchet-toothed annular inner surface, said first and second pawls being disposed within said first insertion slot in said rotary seat, said third and fourth pawls being disposed within said second insertion slot in said rotary seat, one of said compression springs being disposed within said first insertion slot between said first and second pawls so as to bias said first and second pawls away from each other to thereby project respectively from said ends of said first insertion slot, the other of said compression springs being disposed within said second insert slot between said third and fourth pawls so as to bias said third and fourth pawls away from each other to thereby project respectively from said ends of said second insertion slot, said first and fourth pawls being aligned with each other in a second transverse direction perpendicular to said first transverse direction, said second and third pawls being aligned with each other in said second transverse direction;

wherein, when said adjusting ring is disposed in said anchoring position, each of said first, second, third, and fourth pawls engages a respective one of said retaining grooves in said adjusting ring and said ratchet-toothed annular inner surface of said ratchet wheel so as to prevent rotation of said ratchet wheel on said rotary seat of said main body;

when said adjusting ring is disposed in said first-direction position, only said second and fourth pawls engage two corresponding ones of said retaining grooves in said adjusting ring, respectively, and said ratchet-toothed annular inner surface of said ratchet wheel so as to allow for rotation of said ratchet wheel on said rotary seat in only a first rotational direction; and when said adjusting ring is disposed in said second-direction position, only said first and third pawls engage two corresponding ones of said retaining grooves in said adjusting ring, respectively, and said ratchet-toothed annular inner surface of said ratchet wheel so as to allow for rotation of said ratchet wheel on said rotary seat in only a second rotational direction opposite to said first rotational direction.

2. A ratchet driving mechanism as claimed in claim 1, wherein said grip-connecting member of said main body has a large-diameter portion, a small-diameter portion connected integrally to said large-diameter portion and having an outer diameter smaller than that of said large-diameter portion, and a shoulder defined between said large-diameter and small-diameter portions, said small-diameter portion being formed with an end surface, said rotary seat being connected fixedly to said end surface of said small-diameter portion and having an outer diameter smaller than that of said small-diameter portion, said adjusting ring having a cylindrical portion sleeved on said small-diameter portion of said grip-connecting member in a close-fitting manner and having an end abutting against said shoulder, and an inward flange extending radially and inwardly from the other end of said cylindrical portion and formed with said retaining grooves, said inward flange having an inner periphery abutting against said rotary seat.

3. A ratchet driving mechanism as claimed in claim 1, wherein said cylindrical portion of said adjusting ring has an annular inner surface formed with first, second, and third positioning grooves arranged in a circumferential direction thereof, said small-diameter portion of said grip-connecting member including a spring-biased ball disposed thereon, said adjusting ring being operable to rotate on said rotary seat so as to engage said ball with a selected one of said positioning grooves in said adjusting ring, thereby maintaining said adjusting ring at a corresponding one of said anchoring position, said first-direction position, and said second-direction position.

4. A ratchet driving mechanism as claimed in claim 1, wherein said main body further includes a retaining member disposed within said ratchet wheel and connected fixedly to and extending axially from said rotary seat, said retaining member having an annular outer surface formed with an annular groove, said ratchet wheel having an annular inner surface formed with an annular groove, said main body further including a C-shaped retaining ring engaging said annular grooves in said retaining member and said ratchet wheel so as to prevent removal of said main body from said ratchet wheel.

* * * * *